United States Patent [19]

Ogle et al.

[11] Patent Number: 4,707,616

[45] Date of Patent: Nov. 17, 1987

[54] ELECTRIC ENGINE STARTER

[75] Inventors: Douglas R. Ogle, Indianapolis; Daniel D. Richey, New Castle; James L. Whitehurst, Hartford City, all of Ind.

[73] Assignee: General Motors Corporation, Detroit, Mich.

[21] Appl. No.: 26,991

[22] Filed: Mar. 17, 1987

[51] Int. Cl.[4] ..... F02N 11/08

[52] U.S. Cl. ..... 290/48; 74/6; 123/179 R

[58] Field of Search ..... 290/48, 38 R; 74/6, 74/7 R, 7 A; 123/179 R, 179 M

[56] References Cited

U.S. PATENT DOCUMENTS

| | | | |
|---|---|---|---|
| 2,354,844 | 8/1944 | Thornburg | 74/6 |
| 2,623,186 | 12/1952 | Wilde | 290/48 X |
| 3,177,368 | 4/1965 | Seilly | 290/48 X |
| 3,771,372 | 11/1973 | Asahi et al. | 74/7 R |
| 3,775,730 | 11/1973 | Rowls et al. | 339/116 R |
| 3,928,079 | 12/1975 | Jennings et al. | 339/116 R X |
| 4,404,533 | 9/1983 | Kurihara et al. | 335/131 |
| 4,440,033 | 4/1984 | Kurihara et al. | 74/7 A |
| 4,649,285 | 3/1987 | Mazzorana et al. | 290/48 |
| 4,661,715 | 4/1987 | Volino | 290/48 |

*Primary Examiner*—William M. Shoop, Jr.
*Assistant Examiner*—W. E. Duncanson, Jr.
*Attorney, Agent, or Firm*—C. R. Meland

[57] ABSTRACT

An electric starter for cranking an internal combustion engine. The starter has a solenoid which has a motor terminal. The motor terminal is connected to the electric cranking motor of the starter by conductor means which are located entirely internally of the starter. The solenoid has a battery terminal that is provided with a threaded bore that is adapted to receive a connector bolt.

4 Claims, 2 Drawing Figures

ELECTRIC ENGINE STARTER

Figure 1:
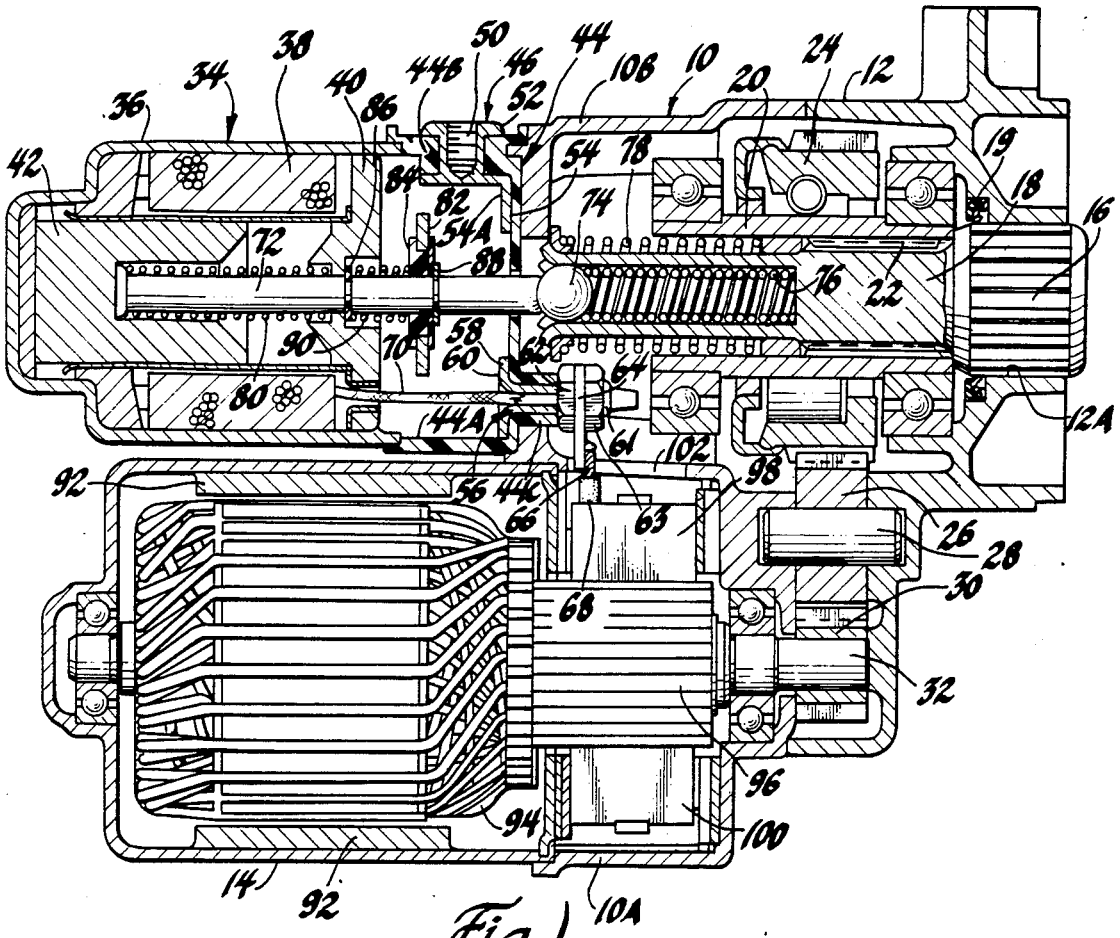

This invention relates to an electric starter for cranking an internal combustion engine and more particularly to a starter that has improved electrical connections for connecting a terminal of the starter solenoid to the electric cranking motor and for providing an improved battery terminal for the starter solenoid.

The Thornburg U.S. Pat. No. 2,354,844 relates to an electric engine starter. In that patent a conductor strap that connects a solenoid terminal to the electric cranking motor is enclosed by a housing that has a removable cover. One of the objects of this invention is to protect the electrical connector or connecting means that connects the motor terminal of a starter solenoid to the electric cranking motor from the environment external of the starter. Instead of utilizing a housing and cover arrangement of the type disclosed in the above-referenced Thornburg patent, to enclose the electrical connecting means, this invention provides an arrangement wherein the connecting means that connects the motor terminal to the electric motor is located internally of the starter so that no additional cover or housing is required to enclose the connecting means. More specifically, the electric cranking motor of this invention utilizes a housing means that encloses the apparatus that drives the pinion of the electric starter. The solenoid is supported by this housing means and a motor terminal is provided that has a contact portion located in the solenoid and a motor connector portion that is disposed within the housing that contains the pinion drive apparatus. This motor connector portion of the motor terminal is electrically connected to the interior of the electric cranking motor by a conductor means that extends between this motor connector portion of the motor terminal and the interior of the electric cranking motor. Accordingly, the electrical connection between the motor terminal of the solenoid and the interior of the electric cranking motor is disposed entirely internally of the housing parts of the electric starter.

Another object of this invention is to provide an electric starting apparatus of the type described wherein the solenoid has a cover member that is formed of insulating material. This cover member is clamped between the casing of the solenoid and a part of a housing that contains the pinion drive mechanism. This cover member carries a battery terminal and carries the motor terminal that electrically connects the interior of the solenoid and the interior of the housing that contains the pinion drive mechanism.

Another object of this invention is to provide a new and improved battery terminal for an electric starter. This battery terminal comprises an electrically conductive part which has a threaded bore. The bore is adapted to receive a threaded bolt of an electrical connector that has resilient or flexible plastic material that is compressed against the end of the battery terminal when the bolt is threaded into the threaded bore of the battery terminal. This arrangement provides a fluid tight seal to thereby seal the electrical connection between a connector that is connected to a battery cable and the battery terminal of the electric starter.

IN THE DRAWINGS

Figure 2:
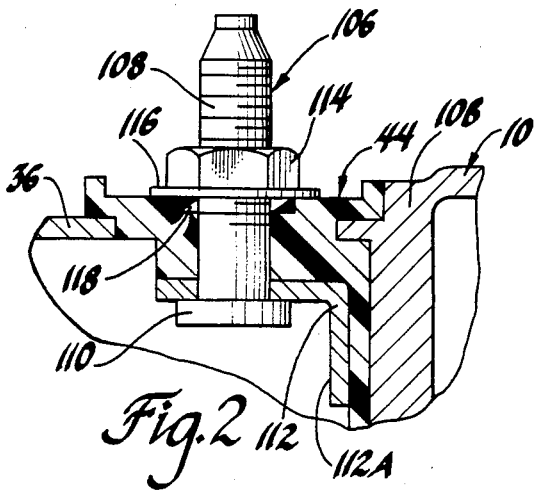

FIG. 1 is a sectional view of an electric starter made in accordance with this invention; and FIG. 2 is a sectional view of a modified battery terminal for the electric starter illustrated in FIG. 1.

Referring now to FIG. 1, the reference numeral 10 generally designates an intermediate or middle housing of the starter of this invention. The housing 10 is formed of metallic material and has open ends respectively facing metallic housing 12 and a metallic housing 14 of an electric cranking motor. The housing 12 is fastened to the housing 10 by bolts or screws (not illustrated) which have threaded portions threaded into suitable threaded bores formed in the housing 10. The heads of these bolts or screws engage the housing 12. The metallic housing 14, of the electric cranking motor, is also fastened to the housing 10 by bolts or screws (not illustrated) which are threaded into suitable threaded bores formed in lugs on the motor housing 14. These bolts or screws pass through lugs on the housing 10 and the heads of these bolts or screws engage these lugs. The housing 10 has tubular housing portions 10A and 10B. The housing portion 10B, together with housing 12, contain or enclose apparatus for driving the pinion of the starter. The pinion of the starter is designated by reference numeral 16 and is integral with the pinion shaft 18. The housing 12 has a bore 12A that receives the pinion 16. The housing 12 carries seal 19 that engages the pinion and pinion shaft. The pinion shaft 18 is driven by a tubular shaft 20 through splines 22. The shaft 20 is rotatably driven by a gear 24 through an overrunning clutch. The gear 24 meshes with the gear 26 that is journaled on pin 28. The gear 26 meshes with a gear 30 which is driven by a shaft 32. The shaft 32, as will be more fully described hereinafter, is the armature shaft of the armature of the electric cranking motor.

The electric starter of this invention has a solenoid which is generally designated by reference numeral 34. This solenoid has a steel case 36 which contains a coil winding 38. The coil winding 38 is comprised of a pull-in coil and a hold-in coil of the type disclosed in the Gresley et al. U.S. Pat. No. 4,540,962. The solenoid 34 has a metallic plunger stop 40 and has a steel plunger 42.

The solenoid 34 has a one-piece cover generally designated by reference numeral 44 which is formed of a plastic insulating material. The cover 44 has an annular portion 44A and a portion 44B. A metallic battery terminal 46 is molded into the portion 44B of the cover 44. The battery terminal 46 has a threaded bore 50 which is adapted to receive a connector bolt. The battery terminal 46 further has a curved annular portion 52. In addition, terminal 46 has an integral portion 54 that is provided with a contact face or surface 54 that is adapted to be engaged by an electrical contactor in a manner to be described.

The cap 44 abuts housing 10 and case 36 and is clamped between these parts. This is accomplished by screws or bolts (not illustrated) that have heads that engage the end wall of housing portion 10B. These screws or bolts have threaded portions that are threaded into threaded bores formed in the plunger stop 40 to thereby clamp cover 44 between case 36 and housing 10. These screws or bolts can pass through openings formed in the end wall of cap 44.

The cap 44 has an axially extending tubular portion 44C. Disposed within the bore of the tubular portion 44C is a portion of a metallic conductive motor terminal 56. The terminal 56 is hollow and may be of the type disclosed in the above-referenced Gresley et al. U.S. Pat. No. 4,540,962. The terminal 56 has a portion 58 that provides a contact face 60 that is adapted to be engaged by a movable contactor of the solenoid. The terminal 56 has an externally threaded portion 61 which is located within the housing portion 10B. A pair of nuts 62 and 63 are threaded onto this threaded portion. The nut 62 serves to fix the terminal 56 to the cover 44. Disposed between the nuts 62 and 63 is a flat terminal plate 64 that has an aperture that receives the threaded portion 61 of the terminal 56. The nut 63 clamps the terminal plate 64 against the nut 62.

The terminal plate 64 is electrically connected to a stranded conductor 66 that is insulated by an insulating cover 68. The stranded conductor 66 is welded to the terminal plate 64. As will be more fully described hereinafter, the terminal plate 64 and conductor 66 serve to electrically connect the motor terminal 56 to the interior of the electric cranking motor. The pull-in coil of the coil winding 38 is electrically connected to the motor terminal 56 by a conductor 70. This can be accomplished in a manner disclosed in the above-referenced Gresley et al. patent.

The plunger 42 of the solenoid 34 is moved to the right in FIG. 1 when the coil winding 38 is energized. The plunger 42 can move a plunger rod 72. The rod 72 extends through a hole in cover 44 and engages a ball 74 which in turn engages a spring 76 disposed within a bore of the pinion shaft 18. The rod 72 and the parts just described serve to move the pinion 16 into mesh with a ring gear of an engine to be cranked when coil 38 is energized. Axial movement of the pinion shaft 18 is opposed by a spring 78. The spring 80 opposes movement of the plunger 42 and the plunger rod 72.

The plunger rod 72 carries an electric contactor 82 which is supported by an insulator 84. An annular part 86 is fixed to the plunger rod 72 as is an annular part 88. A spring 90 forces the insulator 84 against the part 88. When the coil 38 is energized the pinion is moved in a meshing direction and the contactor 82 is moved into engagement with the face or surface 54A of battery terminal 46 and into engagement with the surface or face 60 of motor terminal 56. The contactor, in this position, electrically connects the battery terminal 46 to the motor terminal 56.

The electric cranking motor for driving the pinion, as previously described, includes the steel housing 14 and the shaft 32. The field for providing the field flux for the electric cranking motor can be provided by a plurality of circumferentially spaced permanent magnets 92 that are secured to housing 14. Alternatively, the field can be provided by a plurality of field coils in a known manner.

The armature for the cranking motor comprises a slotted armature core that is connected to shaft 32. The armature core carries an armature winding 94 that is connected to a commutator 96. The commutator is located within portion 10A of housing 10.

The commutator 96 is engaged by four brushes that are suitably supported by brushholders and which are spring biased into engagement with the commutator. The brushes are spaced by 90°. Two of the brushes are illustrated in FIG. 1 and identified respectively by reference numerals 98 and 100. Two opposed brushes of the four brushes are electrically connected to the starter housing and hence are grounded when the starter is secured to an engine.

If the cranking motor has a permanent magnet field a pair of opposed brushes of the four brushes are connected to terminal plate 64. Assuming that the motor does have a permanent magnet field, as shown in FIG. 1, a pair of brush conductors that are respectively connected to the pair of brushes are connected to terminal plate 64. In FIG. 1, only one of these brush conductors 66 has been illustrated but it is to be understood that two brush conductors are utilized that are connected respectively to a pair of opposed brushes.

If the cranking motor uses field coils instead of permanent magnets to provide the field for the motor the terminal 56 is connected to the field coils of the motor instead of directly to a pair of brushes. This can be accomplished by utilizing the terminal plate 64 and connecting this plate to the field coils instead of directly to a pair of brushes. Where field coils are used the ends of the field coils opposite the ends connected to terminal plate 64 are connected to opposed brushes.

It should be pointed out that housing 10 is provided with a slot or opening 102. The conductor 66 passes through this slot and a portion of the terminal plate 64 is disposed in slot 102. This slot therefore provides an opening that permits a conductor means to connect the interior of that part of the housing that encloses the pinion driving mechanism and the interior of the cranking motor.

It should be apparent, from the foregoing, that the terminal plate 64 and conductor 66 that forms the means for connecting the motor terminal 56 to the cranking motor are located entirely internally of the starter. Therefore, this connecting means is protected from the environment external to the starter. This has been accomplished without the use of an additional housing and cover of the type disclosed in the above-referenced Thornburg patent.

It has been previously pointed out that the battery terminal 46 has a threaded bore 50 that is adapted to receive a connector bolt. The type of electrical connector that is to be used with the battery terminal 46 is of a type that is disclosed in the Rowls et al. U.S. Pat. No. 3,775,730 and Jennings et al. U.S. Pat. No. 3,928,079. The connector devices of these two patents have a connector bolt that is adapted to be threaded into the threaded bore 50 of battery terminal 46. Further, the connector devices shown in these patents have an annular elastomeric portion which seals against the end of terminal 46 and against the annular portion 52 of motor terminal 46 when the connector is secured to the motor terminal. This elastomeric portion further can be forced into contact with the portion of the cover 44 located adjacent the annular portion 52 of the motor terminal 46. A sealed connection is therefore provided when connectors of the type disclosed in the above-referenced Rowls et al. and Jennings et al. patents are utilized to connect a battery cable to the battery terminal 46.

FIG. 2 illustrates a battery terminal that can be utilized instead of the terminal 46, illustrated in FIG. 1. In FIG. 2 the reference numeral 44 designates the end cover of the solenoid shown in FIG. 1. In FIG. 2 a terminal stud 106 is utilized which has a threaded portion 108 and a head 110. The terminal stud passes through an opening formed in the cover 44. A fixed electrical contact 112 is clamped against the cover 44 by the head 110 of the terminal stud when the nut 114 is tightened. The fixed contact 112 has a contact face 112A which performs the same function as the contact face 54A of the battery terminal 46. The nut 114 engages a washer 116 and an elastomeric O-ring seal 118 is provided which is compressed into a recess by the washer 116. When connecting a battery to the battery terminal 106 the battery cable is provided with an eyelet type of terminal which is assembled to the threaded portion 108. Another nut (not illustrated) is then utilized to clamp the eyelet type terminal between this other nut and nut 114.

The embodiments of the invention in which an exclusive property or privilege is claimed are defined as follows:

1. An electric starter for cranking an internal combustion engine comprising, first housing means, a pinion for said starter, said first housing means containing pinion driving means, a solenoid having an actuating coil and a shiftable plunger, said solenoid secured to said first housing means, said solenoid having a first terminal that is adapted to be connected to a source of direct voltage, first switch contact means disposed within said solenoid connected to said first terminal, said solenoid having a second terminal that has second switch contact means disposed within said solenoid, said second terminal having a portion thereof located within said first housing means, a contactor shiftable by movement of said plunger into engagement with said first and second contact means, an electric cranking motor enclosed by second housing means, and electrical connector means connecting said portion of said second terminal that is located in said first housing means to said cranking motor, said connector means being enclosed by said first and second housing means.

2. The electric starter according to claim 1 wherein said solenoid has an end cap formed of insulating material and wherein said first and second terminals are carried by and extend through openings formed in said end cap.

3. The electric starter according to claim 1 wherein said first terminal has a theaded bore that is adapted to receive a threaded connector bolt and an integral contact portion that is adapted to be engaged by said contactor.

4. The electric starter according to claim 1 wherein the solenoid has a metallic case and wherein a part formed of insulating material is disposed between and in engagement with said case and said first housing means, said part forming a cap for said solenoid, said first and second terminals being carried by said part and extending through openings in said part.

* * * * *